US010577781B2

(12) United States Patent
Blattner

(10) Patent No.: US 10,577,781 B2
(45) Date of Patent: Mar. 3, 2020

(54) FAUCET COLUMN AND FREE-STANDING SANITARY FITTING SYSTEM

(71) Applicant: Hansgrohe SE, Schiltach (DE)

(72) Inventor: Joachim Blattner, Haslach (DE)

(73) Assignee: Hansgrohe SE, Schiltach (DE)

( * ) Notice: Subject to any disclaimer, the term of this patent is extended or adjusted under 35 U.S.C. 154(b) by 4 days.

(21) Appl. No.: 15/720,477

(22) Filed: Sep. 29, 2017

(65) Prior Publication Data

US 2018/0094412 A1 Apr. 5, 2018

(30) Foreign Application Priority Data

Oct. 4, 2016 (DE) ..... 10 2016 219 218

(51) Int. Cl.
*E03C 1/04* (2006.01)

(52) U.S. Cl.
CPC ..... *E03C 1/0401* (2013.01); *E03C 1/04* (2013.01); *E03C 1/0403* (2013.01); *E03C 1/0404* (2013.01); *E03C 2001/0416* (2013.01); *Y10T 137/6014* (2015.04)

(58) Field of Classification Search
CPC .. E03C 1/04; E03C 1/0403; E03C 2001/0416; Y10T 137/6014
USPC ..... 248/68.1
See application file for complete search history.

(56) References Cited

U.S. PATENT DOCUMENTS 2,196,301 A 4/1940 Heine
6,029,690 A * 2/2000 Weineland ..... E03C 1/0403 137/207
7,032,260 B2 * 4/2006 Hwang ..... E03C 1/0403 4/695
7,043,777 B2 * 5/2006 Bloom ..... E03C 1/0401 249/177
8,453,669 B2 * 6/2013 Veros ..... E03C 1/04 137/315.13
8,584,697 B2 * 11/2013 Hsu ..... F16K 19/006 137/315.12
9,051,719 B2 * 6/2015 Li ..... E03C 1/0402
(Continued)

FOREIGN PATENT DOCUMENTS

CH 235533 3/1945
DE 10310256 A1 9/2003
(Continued)

OTHER PUBLICATIONS

Search Report issued by the European Patent Office (Munich), dated Jan. 31, 2018, for related Application No. EP17194009; 7 pages.

*Primary Examiner* — Kevin F Murphy
(74) *Attorney, Agent, or Firm* — Faegre Baker Daniels LLP

(57) ABSTRACT

A faucet column and/or free-standing sanitary fitting with the faucet column includes a floor-side column end and a faucet-carrying column end, with at least one water conduit disposed within the faucet column, extending from the floor-side column end up to the faucet-carrying column end. The faucet column includes a supporting profile which extends from the floor-side column end up to the faucet-carrying column end, at least one cavity which encompasses the water conduit and extends from the floor-side column end up to the faucet-carrying column end and is provided by the supporting profile, and an enveloping element which surrounds the supporting profile.

12 Claims, 4 Drawing Sheets

(56) References Cited

U.S. PATENT DOCUMENTS

| | | | | |
|---|---|---|---|---|
| 9,334,634 | B2 * | 5/2016 | Bares | E03C 1/0403 |
| 2003/0168110 | A1 | 9/2003 | Bregoli | |
| 2013/0112287 | A1 | 5/2013 | Kronenbitter et al. | |

FOREIGN PATENT DOCUMENTS

| | | | |
|---|---|---|---|
| DE | 10261798 | A1 | 7/2004 |
| DE | 102007009409 | A1 | 9/2008 |
| DE | 102011085346 | A1 | 5/2013 |
| EP | 1357233 | A1 | 10/2003 |

* cited by examiner

FAUCET COLUMN AND FREE-STANDING SANITARY FITTING SYSTEM

The invention relates to a faucet column for a free-standing sanitary fitting, which has a floor-side column end and a faucet-carrying column end and also at least one water conduit within the faucet column, extending from the floor-side column end to the faucet-carrying column end, and a free-standing sanitary fitting system equipped therewith.

Faucet columns of this type are marketed for example by the applicant in the form of floor-standing bathtub mixers or bathtub thermostats. For this purpose, it is known practice to use, for the purpose of stability, relatively thick-walled brass pipes and, for conducting water, copper pipes. For installation, the pipe ends frequently have to be reworked, and relatively long threaded rods are used for fastening.

It is an object of the invention to provide a faucet column of the type mentioned at the beginning, which is advantageous with respect to the prior art explained above, in particular with regard to production costs and installation effort, and a sanitary fitting system equipped therewith.

The invention achieves these and other objects by providing a faucet column which comprises a floor-side column end and a faucet-carrying column end, at least one water conduit within the faucet column, extending from the floor-side column end up to the faucet-carrying column end, a supporting profile, extending from the floor-side column end up to the faucet-carrying column end, at least one cavity, including the water conduit and extending from the floor-side column end up to the faucet-carrying column end and provided by the supporting profile, and an enveloping element, surrounding the supporting profile.

The invention further provides a free-standing sanitary faucet system which comprises a faucet column and a water outlet fitting, configured for attachment to the faucet-carrying column end of the supporting profile, wherein the faucet column comprises a floor-side column end and a faucet-carrying column end, at least one water conduit within the faucet column, extending from the floor-side column end up to the faucet-carrying column end, a supporting profile extending from the floor-side column end up to the faucet-carrying column end, at least one cavity, including the water conduit and extending from the floor-side column end to the faucet-carrying column end and provided by the supporting profile, and an enveloping element, surrounding the supporting profile. Advantageous and preferred configurations of the invention are the subject matter of the further claims, the wording of which is herewith incorporated fully in the description by reference. The supporting profile, as its name suggests, is designed to support a fitting to be installed at the faucet-carrying column end, i.e., to take up the corresponding weight forces. Thus, the enveloping element can be designed independently thereof, i.e., it does not need to have a fitting-supporting function.

The floor-side column end can extend for example from a floor-side end face of the faucet column to the middle of the faucet column. The faucet-carrying column end can extend for example from the middle of the faucet column to an end face of the faucet column which is at the opposite end from the floor-side end face. In the present case, the term floor means any floor surface on which the faucet column can or is intended to be installed in a standing manner, in particular a floor surface of a shower room or bathroom or a flat, horizontal floor surface on or next to a bathtub or washbasin or sink.

The supporting profile can have for example a cross-sectional geometry which is particularly suitable for taking up transverse forces of over 100 N. The supporting profile is for example a metal profile which is configured as a special profile. In a corresponding embodiment, the geometry of the supporting profile can change along the length of the faucet column.

The cavity can be for example a circumferentially partially or completely closed void and/or a circumferentially partially or completely closed opening in the supporting profile. It can serve in particular to conduct water. It is possible for the water conduit from the floor-side column end to the faucet-carrying column end to be formed by the cavity itself. For this purpose, for example the wall of the cavity then has a coating by way of which direct contact between the water conducted in the cavity and the material of the supporting profile is avoided. The cavity can for example have a geometry with at least two sub-cavities which are connected together via at least one opening or a gap.

The enveloping element can surround the supporting profile for example entirely or only along a part of the length of the supporting profile, which can have any desired value between about 80% and about 100%, wherein, if necessary, it can also extend beyond the length of the profile.

Thus, the subject matter of the invention makes it possible to reduce the production and installation costs in that a supporting profile is used which has the water conduit and is surrounded by an enveloping element.

In one configuration of the invention, the water conduit is a pipeline and/or hose line which is arranged within the cavity. In this way, contact between the supporting profile and the water located in the pipeline and/or hose line can advantageously be avoided. The hose line can be for example a soft silicone hose. The pipeline can be for example a plastics pipe.

In one configuration of the invention, the pipeline and/or hose line is supported on at least 60% of its lateral surface by a wall of the cavity. This avoids any undesired fluid-pressure-related deformation of the pipeline and/or hose line, and allows the use of a relatively soft material of lower compressive strength for the pipeline or hose line. As a result of the pipeline and/or hose line being supported against the wall of the cavity, greater pressure resistance of the pipeline and/or hose line can be achieved. The specified percentage of the lateral surface of the pipeline and/or hose line which is supported by the wall of the cavity can have any desired value in the range from 60% to 100%.

In one configuration of the invention, the supporting profile is a structural profile or a profiled steel. The structural profile can be for example a rigid profile made of aluminium or some other material of high flexural rigidity, for example a fibre-reinforced plastics material. The structural profile or the profiled steel can have for example a profile which is suitable in particular for taking up transverse forces and has a cavity which is suitable for conducting water and/or receiving the pipeline and/or the hose line.

In one configuration of the invention, the supporting profile is a profiled extruded section. The extrusion method allows cost-effective production of the supporting profile. Furthermore, the supporting profile can be adapted to a predetermined length simply by cutting it to length.

In one configuration of the invention, the enveloping element is a decorative tube. The decorative tube can be for example a covering which acts as a screen and conceals the supporting profile. For this purpose, the decorative tube can have for example decorative elements and/or is produced in a thin-walled manner from a high-grade material, for example brass, stainless steel or a combination of high-grade materials. In order to surround the supporting profile, the decorative tube can be embodied for example as a hollow profile or cover sleeve. It is possible for the decorative tube to completely cover the supporting profile towards the outside.

In one configuration of the invention, the geometry of the cross section of the supporting profile has at least one axis of symmetry and/or has point symmetry. The axis of symmetry and/or the point symmetry makes it possible for example for the supporting profile to take up transverse forces virtually irrespectively of direction. Furthermore, in corresponding cases, the axis of symmetry and/or the point symmetry of the supporting profile simplifies the production and/or installation, inter alia in that the number of possible installation directions is reduced.

In one configuration of the invention, the supporting profile is a one-piece hollow profile and comprises a plurality of cavities. As a result of the use of a plurality of cavities, which each have a water conduit, it is possible for example for heat transfer between the mutually separate water conduits to be reduced or prevented. This relates in particular to the case in which possibly one cavity conducts cold water and another cavity conducts hot water.

A free-standing sanitary fitting system according to the invention comprises the faucet column according to the invention and a water outlet fitting which is designed to be attached to the faucet-carrying column end of the supporting profile. Furthermore, the floor-side column end of the faucet column is designed to be attached to a building floor. In this case, the building floor can have for example a water connection which is attached to the cavity or a pipeline and/or hose line arranged in the cavity at the floor-side column end, in order to supply the faucet column with water, which is then passed on to the water outlet fitting. The water outlet fitting is connected to the supporting profile at the faucet-carrying column end such that its weight force is taken up by the supporting profile and is introduced into the building floor.

Advantageous embodiments of the invention are illustrated in the drawings and explained in more detail in the following text. In the drawings.

Figure 1:
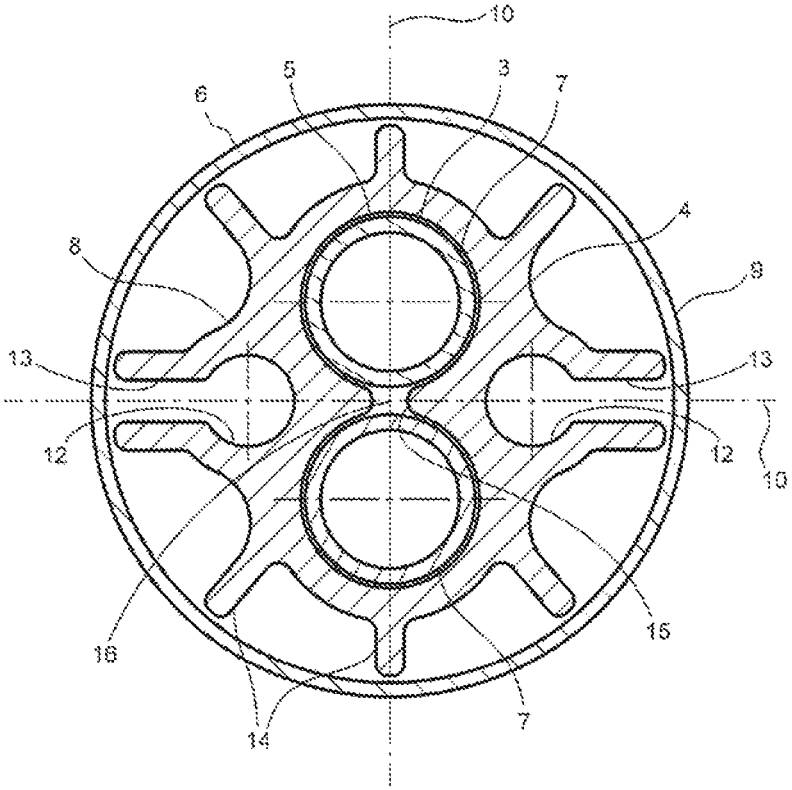
FIG. 1 shows a cross section through a faucet column.

As can be seen in FIG. 1, the faucet column shown has an enveloping element 6 and a supporting profile 4, wherein the supporting profile 4 is embodied as a one-piece hollow profile which has a closed cavity 5 and an open cavity 12 in duplicate. The enveloping element 6 is arranged in a manner surrounding the supporting profile 4.

Each of the two open cavities 12 is suitable for receiving a water conduit. In order to make it easier to insert an elastic line as water conduit, each open cavity 12 has a respective opening 13 radially towards the outside, which extends as a gap along the entire length of the faucet column. If necessary, it is thus possible for an elastic hose or the like to be inserted into the open cavity 12 in that said hose is pushed laterally through the opening 13 into the open cavity 12 and thus into the supporting profile 4. Alternatively and/or in addition, the open cavity 12 can be used to connect the supporting profile 4 to, for example, a water outlet fitting and/or a supporting floor by means of screws and/or pins.

Furthermore, the closed cavity 5 is also suitable as a water conduit or for receiving a water-conducting line. In the embodiment shown in FIG. 1, the closed cavity 5 has two sub-cavities, which are connected together via a gap opening 15. The closed cavity 5 with its two sub-cavities has, in cross section, the geometric shape of an eight. Both of the sub-cavities each have a water conduit 3 in the form of a pipeline or hose line 7 made of plastics material, wherein one water conduit 3 is configured to conduct hot water and the other water conduit 3 is configured to conduct cold water. In order to insert the respective pipeline/hose line 7 into the relevant sub-cavity or to remove it therefrom, the closed cavity 5 is accessible from at least one end side of the supporting profile 4.

The supporting profile 4 is a structural profile 8 made for example of aluminium that was produced by an extrusion method. In order to increase the rigidity and/or flexural rigidity of the supporting profile 4, the latter has reinforcing ribs 14. With regard to a centre 16 of the cross-sectional geometry of the supporting profile 4, the reinforcing ribs 14 extend in a radial direction. The reinforcing ribs 14 allow the supporting profile 4 to take up greater transverse forces. Furthermore, in terms of its cross-sectional geometry, the supporting profile 4, including its reinforcing ribs 14, is symmetrical with regard to two mutually perpendicular axes of symmetry 10 and has point symmetry with regard to the centre 16.

The supporting profile 4 is surrounded by the enveloping element 6, which, in the example shown, is configured as a decorative tube 9 in the form of a circular-cylindrical tube. In an embodiment (not shown) of the faucet column, the decorative tube 9 can be for example in touching contact with the reinforcing ribs 14, which as a result perform a supporting and centring function for the decorative tube 9. The decorative tube 9 consists preferably of a higher-grade material than the supporting profile 4. Forces that occur, for example the weight force of a water outlet fitting or transverse forces as a result of actuation of a water outlet fitting fastened to the supporting profile 4, are taken up predominantly by the supporting profile 4. Thus, the decorative tube 9 takes up at most a small proportion, for example less than 50%, of the forces that occur and can consequently be configured in a material-saving and thin-walled manner, for example with a wall thickness of less than 5 mm.

In alternative variant embodiments (not shown) of the faucet column, the faucet column has a single water conduit or more than two water conduits. The water conduits can be formed by means of a pipeline or hose line or a combination of both line possibilities. Thus, in the case of a plurality of water conduits, it is possible for example for one water conduit to be realized by a hose line and for the remaining water conduits each to be realized by a pipeline.

Figure 2:
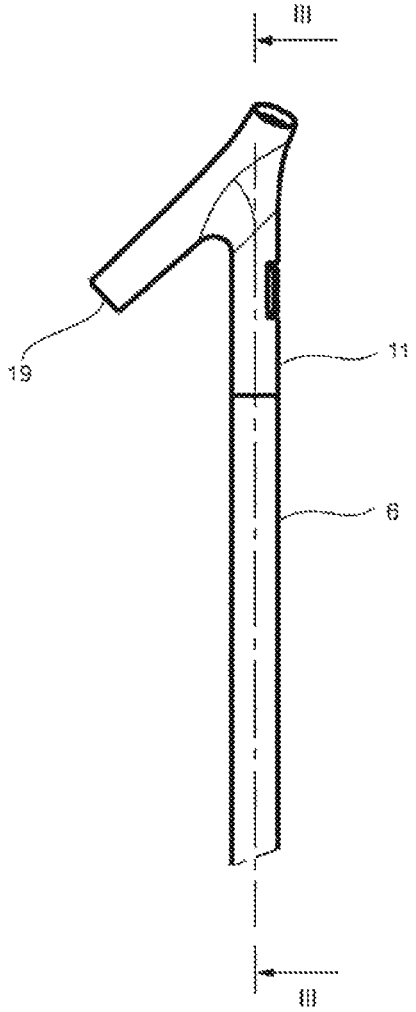
FIG. 2 shows a partial side view of a free-standing sanitary fitting system having the faucet column in FIG. 1.
Figure 3:
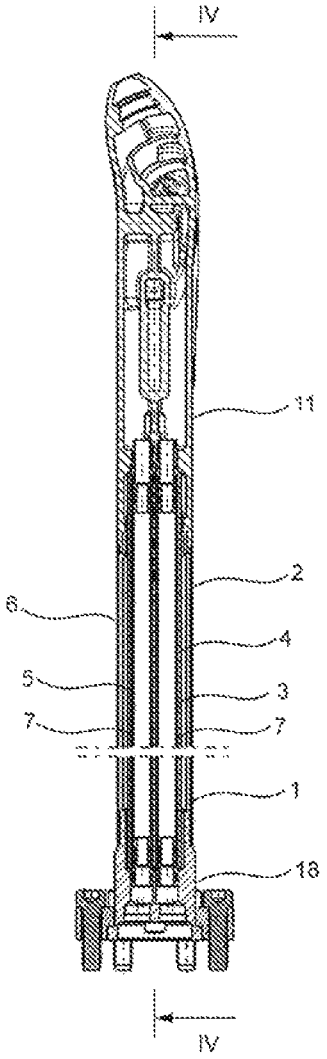
FIG. 3 shows a sectional view of the sanitary fitting system along a line III-III in FIG. 2.
Figure 4:
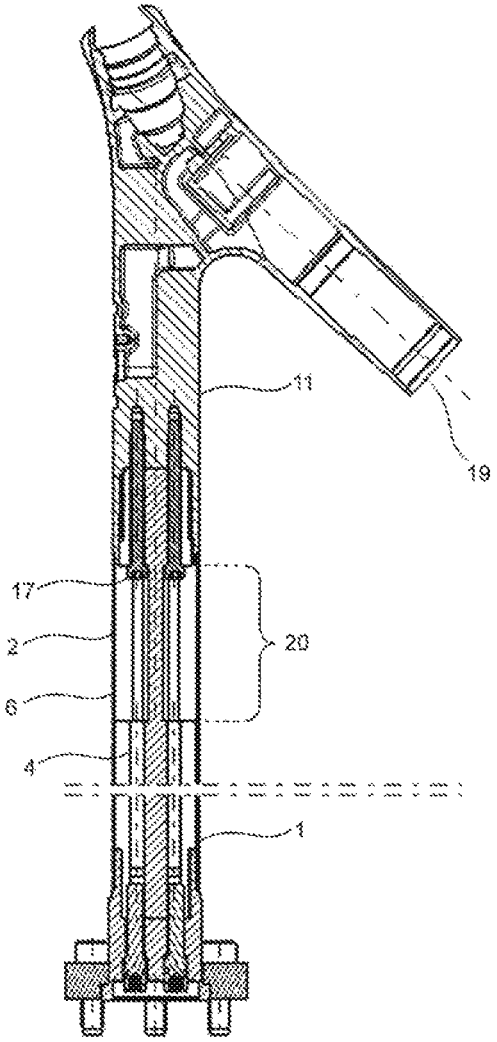
FIG. 4 shows a sectional view of the sanitary fitting system along a line IV-IV in FIG. 3.

FIGS. 2 to 4 show a free-standing sanitary fitting system which has the faucet column according to FIG. 1 and a water outlet fitting 11, wherein the water outlet fitting 11 is embodied in the form of a mixer fitting and has a water outlet opening 19. The water outlet fitting 11 is designed to be attached to the faucet-carrying column end 2 of the supporting profile 4. To this end, the water outlet fitting 11 has a kind of sleeve which is closed on one side and is partially surrounded by the enveloping element 6 and in which the supporting profile 4 of the faucet column is fastened by way of screw connections 17. The supporting profile 4 has a screw insertion region 20, which makes it possible to insert the screws of the screw connections 17 into the open cavities 12 of the supporting profile 4. For this purpose, in the screw insertion region 20, the reinforcing ribs 14, which bound the respective opening 13 of the open cavities 12, have been removed by material machining on the supporting profile 4.

Located on the opposite side from the faucet-carrying column end 2 is a floor-side column end 1 of the faucet column, said end being received in a floor-fastening receptacle 18 in the example shown. The floor-fastening receptacle 18 has a receiving portion in the manner of a sleeve that is closed on one side and in which the supporting profile 4 of the faucet column is fastened. The enveloping element 6 of the faucet column in this case partially surrounds the floor-fastening receptacle 18. The floor-fastening receptacle 18 is fastened to a floor (not illustrated in more detail) via screw connections or pin connections. Furthermore, the floor-fastening receptacle 18 has a water supply which is attached to the water conduit 3 of the faucet column at the floor-side column end 1, wherein the water outlet fitting 11 is connected to the water conduit 3 at the faucet-carrying column end 2.

It is clear from FIG. 2 that the enveloping element 6 surrounds the supporting profile 4 such that the supporting profile 4 of the faucet column cannot be seen and such that flush and touching contact at the end side arises between the enveloping element 6 and the water outlet fitting 11. FIGS. 3 and 4 show that touching contact arises between the enveloping element 6 and the floor-fastening receptacle 18.

In the embodiment shown of the faucet column, the respective pipeline/hose line 7, which is arranged in the cavity 5, is supported on at least 60% of its lateral surface by the wall of the cavity 5, in this case to be more precise by the wall of the respective sub-cavity. As a result of the support against the wall of the cavity 5, the pressure resistance of the respective pipeline/hose line 7 increases. Thus, it is possible, as desired, to select a material for the pipeline/hose line 7 which would not withstand the water pressure without being supported against the cavity.

As the exemplary embodiments explained above make clear, the invention provides a faucet column and a free-standing sanitary fitting system which reduce the production and installation costs in that a supporting profile is used which consists of an easy-to-process and cost-effective material and can be surrounded by an enveloping element made of a higher-grade material.

What is claimed is:

1. A faucet column for a free-standing sanitary fitting, comprising:

a floor-side column end and a faucet-carrying column end, wherein the faucet-carrying column end is a top side end face of the column, at least one water conduit within the faucet column, extending from the floor-side column end up to the faucet-carrying column end, a supporting profile, extending from the floor-side column end up to the faucet-carrying column end, wherein the supporting profile is a profiled extruded section and comprises one of a structural profile and a profiled steel, at least one cavity, encompassing the water conduit and extending from the floor-side column end up to the faucet-carrying column end and provided by the supporting profile, and an enveloping element, surrounding the supporting profile.

2. The faucet column according to claim 1, wherein the water conduit comprises at least one of a tube line and a hose line disposed within the cavity.

3. The faucet column according to claim 2, wherein said at least one of the tube line and the hose line is supported in the cavity on at least 60% of a lateral surface of said at least one of the tube line and the hose line, by a wall of the cavity.

4. The faucet column according to claim 1, wherein the enveloping element comprises a tube.

5. The faucet column according to claim 1, wherein a geometry of the supporting profile has at least one of an axis of symmetry in cross section and a point symmetry.

6. The faucet column according to claim 1, wherein the supporting profile comprises a one-piece hollow profile and the one piece hollow profile comprises a plurality of cavities.

7. A free-standing sanitary faucet system, comprising:

a faucet column having a floor-side column end and a faucet-carrying column end, wherein the faucet-carrying column end is a top side end face of the column, a supporting profile of the faucet column, the supporting profile extending from the floor-side column end up to the faucet-carrying column end, wherein the supporting profile is a profiled extruded section and comprises one of a structural profile and a profiled steel, an enveloping element surrounding the supporting profile, a water outlet fitting configured for attachment to the supporting profile at the faucet-carrying column end, at least one water conduit within the faucet column, extending from the floor-side column end up to the faucet-carrying column end, at least one cavity encompassing the water conduit and extending from the floor-side column end up to the faucet-carrying column end, wherein the at least one cavity is provided by the supporting profile, wherein the floor-side column end of the faucet column comprises structure configured for attachment to a building floor.

8. The free-standing sanitary faucet system according to claim 7, wherein the water conduit comprises at least one of a tube line and a hose line disposed within the cavity.

9. The free-standing sanitary faucet system according to claim 8, wherein said at least one of the tube line and the hose line is supported in the cavity on at least 60% of a lateral surface of said at least one of the tube line and the hose line, by a wall of the cavity.

10. The free-standing sanitary faucet system according to claim 7, wherein the enveloping element comprises a tube.

11. The free-standing sanitary faucet system according to claim 7, wherein a geometry of the supporting profile has at least one of an axis of symmetry in cross section and a point symmetry.

12. The free-standing sanitary faucet system according to claim 7, wherein the supporting profile comprises a one-piece hollow profile and the one piece hollow profile comprises a plurality of cavities.

* * * * *